United States Patent [19]

Gleockler et al.

[11] 4,113,055

[45] Sep. 12, 1978

[54] TREE LADDER

[76] Inventors: Frederick M. Gleockler, R.D. 1, Box 35; Robert G. Gleockler, R.D. 1, Box 38, both of Ridgely, Md. 21660

[21] Appl. No.: 791,465

[22] Filed: Apr. 27, 1977

[51] Int. Cl.[2] ..... E06C 5/06; E06C 1/24

[52] U.S. Cl. ..... 182/63; 182/127; 182/194

[58] Field of Search ..... 182/194, 228, 127, 63, 182/104, 105

[56] References Cited

U.S. PATENT DOCUMENTS

| | | | |
|---|---|---|---|
| 882,161 | 3/1908 | Olive | 182/104 |
| 2,186,119 | 1/1940 | Moen | 182/127 |
| 2,405,453 | 8/1946 | Savage | 182/104 |
| 3,454,132 | 7/1969 | Platino | 182/121 |

*Primary Examiner*—Reinaldo P. Machado
*Attorney, Agent, or Firm*—John N. Randolph

[57] ABSTRACT

A selfsustaining ladder, especially designed for use in harvesting fruit from trees, having an arcuate curvature to generally conform to the horizontal curvature of a segment of a fruit tree. The ladder has more than two uprights and the rungs, each of which connect with all of the upright, are spaced at considerable distances apart to provide maximum accessibility, between the rungs, to the fruit.

8 Claims, 9 Drawing Figures

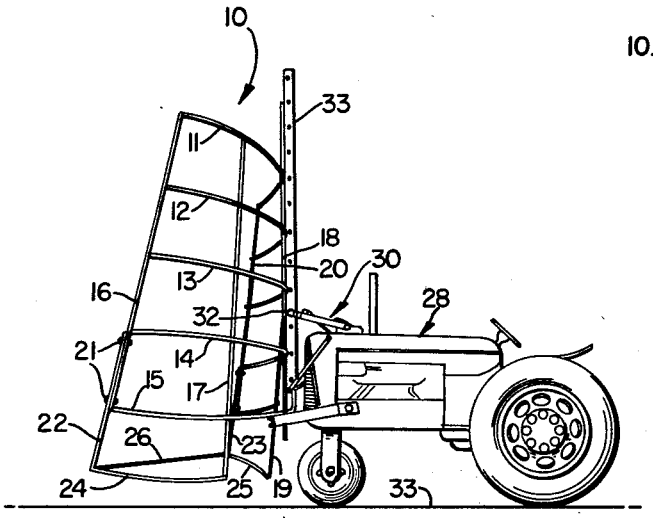
FIG. 1
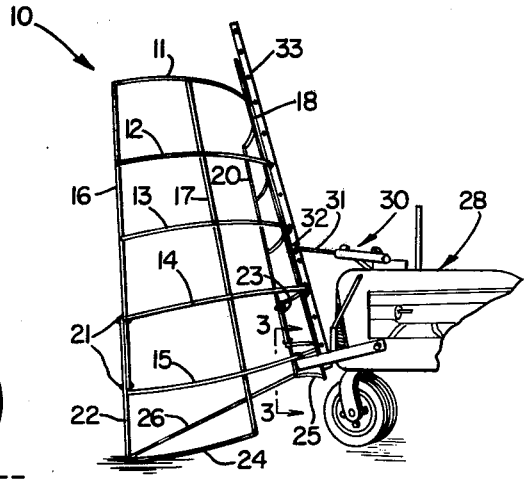
FIG. 2
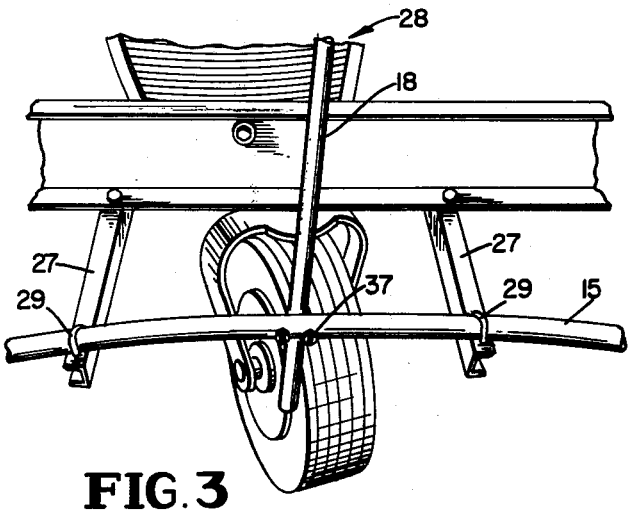
FIG. 3
FIG. 4
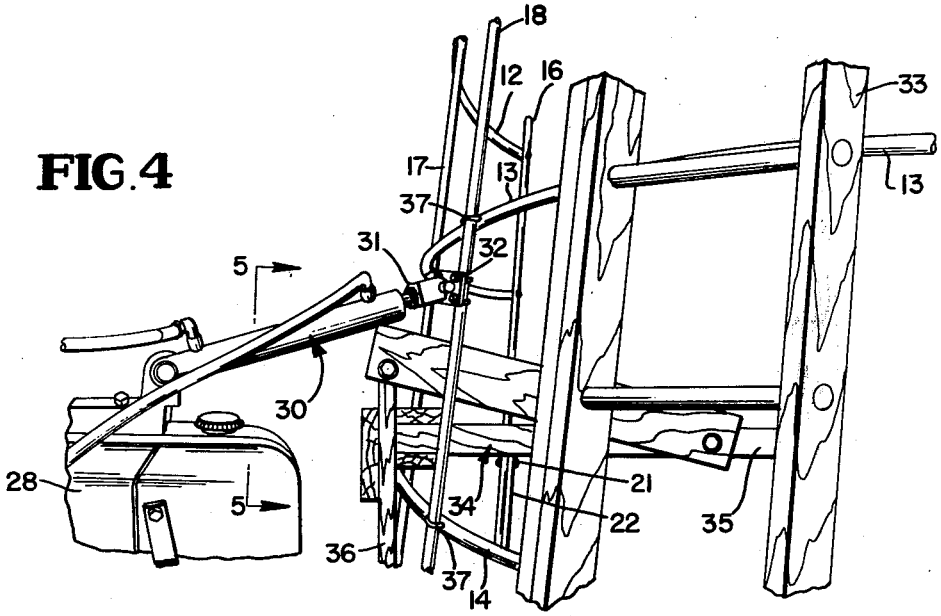

TREE LADDER

SUMMARY

It is a primary object of the present invention to provide a horizontally elongated ladder primarily intended for use in harvesting fruit from trees, including more than two uprights and a plurality of curved rungs, each of which is connected to each upright, to form an arcuately curved ladder which nearly conforms to the horizontal curvature of a segment of a fruit tree and which may be utilized simultaneously by more than one picker.

Another object of the invention is to provide a ladder which is inclined from the bottom to the top thereof to generally conform to the vertical curvature of a fruit tree.

A further object of the invention is to provide a harvesting ladder having means for varying the inclination of the ladder to better conform to the vertical curvature of a segment of a tree.

Another object of the invention is to provide a ladder which may be attached to a wheeled vehicle and by which the ladder may be raised for transport and lowered into a ground engaging position for use.

A further object of the invention is to provide a ladder equipped with transport wheels to facilitate movement of the ladder to different picking locations.

Still another object of the invention is to provide a ladder which will have to be moved less often than other ladders in harvesting fruit from a tree.

Various other objects and advantages of the invention will hereinafter become more fully apparent from the following description of the drawings, illustrating presently preferred embodiments thereof, and wherein:

BRIEF DESCRIPTION OF THE DRAWINGS

FIG. 1 is a side elevational view showing one embodiment of the ladder connected to and supported by a tractor and in a raised transport position;

FIG. 2 is a similar view showing the ladder in a lowered, operative position, with the tractor shown broken away;

FIG. 3 is an enlarged fragmentary view taken along the line 3—3 of FIG. 2;

FIG. 4 is a fragmentary side elevational view looking toward the opposite side of the tractor and ladder, relative to the showing of FIG. 1;

DESCRIPTION OF THE PREFERRED EMBODIMENTS

Figure 5:
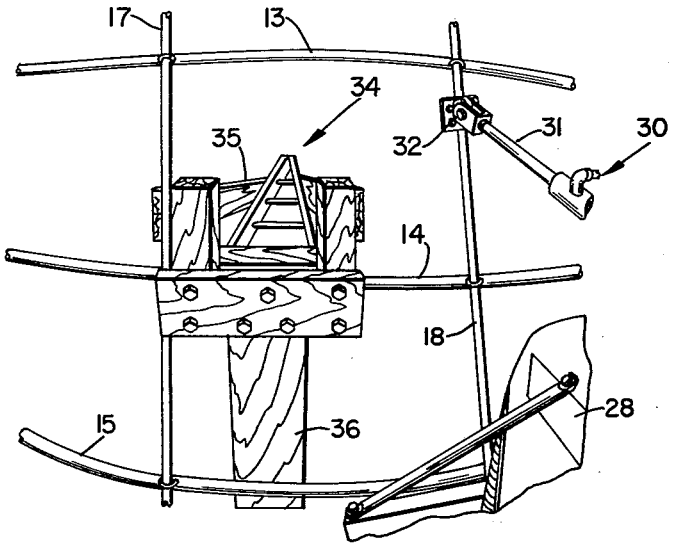
FIG. 5 is an enlarged view looking toward the outer convex side of a portion of the ladder and showing a part of the tractor to which it is attached.
Figure 6:
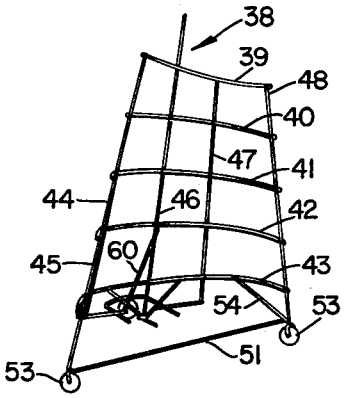
FIG. 6 is a perspective view of another embodiment of the ladder, looking toward the inner concave side thereof.
Figure 9:
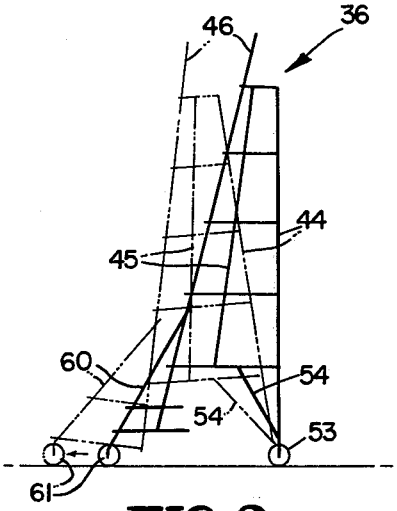
FIG. 9 is a diagrammatic view in end elevation of the self-sustaining ladder of FIG. 6 and illustrating two different angularly adjusted positions thereof.

FIGS. 1 to 5 illustrate one embodiment of the ladder, designated generally 10 and comprising the invention. The ladder 10 includes five curved rungs 11, 12, 13, 14 and 15, and five uprights 16, 17, 18, 19 and 20. The number of uprights and rungs can be varied. Each of the rungs is connected to each of the uprights and said rungs terminate at the two outside uprights 16 and 20. The uprights 17, 18 and 19 are disposed nearly parallel to one another, whereas the two side uprights 16 and 20 converge relative to the other uprights from their lower to their upper ends. Uprights 16 and 20 terminate at the bottom rung 15 and upright 18 terminates below but adjacent the bottom rung 15 and substantially above the lower ends of the rungs 17 and 19.

The two outside uprights 16 and 20 have spaced openings, not shown, between the rungs 14 and 15, to selectively receive fastenings 21 by means of which extensible sections 22 and 23 are adjustably connected to the uprights 16 and 20 so as to extend different distances therebelow. An arcuate brace 24 extends between the lower end of the extension 22 and the lower end of the upright 17; and an arcuate brace 25 extends between the lower end of the extension 23 and the upright 19. Said braces 24 and 25 are capable of flexing relative to the uprights 17 and 19, respectively, to compensate for downward extension of the members 22 and 23 relative to the uprights 16 and 20. The extensions 22 and 23 are also braced by a cross brace 26 which extends between the lower ends thereof.

As seen in FIGS. 1 to 3, rigid arms 27 are secured to and extend forwardly from a wheeled vehicle, such as a tractor 28, and are connected by U-bolt fastenings 29 to the rung 15 intermediate of its ends, so that said rung can oscillate in the fastenings 29 on the arms 27.

A conventional hydraulic lift 30 is pivotally mounted on the tractor 28 and extends forwardly therefrom. Piston rod 31 of the hydraulic cylinder of said lift 30 is pivotally connected at its outer or forward end to a bracket 32 which is clamped to the middle upright 18, preferably between the rungs 13 and 14. Accordingly, when the piston rod 31 is retracted into the cylinder of the lift 30, as seen in FIG. 1, the ladder 10 will be rocked clockwise on the arms 27 to its raised, inoperative position, in which the ladder will be elevated off of the ground 33 and supported solely by the tractor 28 for transport. When the piston 31 is extended, as seen in FIG. 2, the ladder will be rocked in the other direction or counterclockwise so that the brace 26 and the lower ends of the extensions 22 and 23 will rest on the ground. In its position of FIG. 2, the ladder is in its operative position for use and may support one or more pickers, not shown, who may stand on different rungs for picking fruit from a tree, not shown, around a segment of which the ladder 10 is disposed. The rungs are spaced a considerable distance apart to afford additional space between said rungs to increase the accessibility of the fruit to the picker. As seen in FIGS. 4 and 5, the rungs and uprights may be secured together by U-bolt and nut fastenings 37.

A conventional straight ladder 33, which forms no part of the present invention, may be placed against the outer convex side of a part of the ladder 10 and used by the pickers for descending or ascending the ladder 10, where the rungs 11–15 are spaced too far apart to be used conveniently as conventional ladder rungs. Said ladder 33 may be temporarily attached to the outer side of the ladder 10 to be moved therewith. The intermediate upright 18 may extend above the uppermost rung 11 to provide a handhold for pickers standing on the rung 12. Ladder 10 is capable of supporting ladder 33 out of contact with a tree and with a worker standing on ladder 33 above the top of ladder 10.

It will be apparent that if the extensions 22 and 23 are adjusted downwardly from their positions of FIGS. 1 and 2, that the ladder 10 will assume a more upright position when in its lowered position of FIG. 2; or, if said extensions are adjusted upwardly, the ladder 10 will assume a more inclined position when disposed as seen in FIG. 2 with the brace 26 resting on the ground, so that the ladder will most nearly conform to the vertical curvature of the portion of a tree being picked.

It will thus be seen that the ladder 10, when utilized as illustrated in the drawings, will provide a convenient structure for use by one or more workers picking fruit from a tree or for trimming a tree, and that said ladder will function without damage to the tree, since no part of the ladder will rest against the tree. Further, a substantially greater area of a tree may be harvested or trimmed without moving the ladder, than is possible when utilizing a conventional ladder.

FIGS. 4 and 5 disclose an attachment 34 forming a part of the invention, which can be detachably connected to certain of the ladder rungs to provide a platform 35 which extends inwardly from the inner side of the ladder 10, to enable a worker to extend his leg inwardly of the ladder between two of the rungs and rest his foot on the platform 35. The outer end of the platform 35 is shown resting on the rung 14, and said attachment 34 has a bar 36 which extends downwardly on the outer convex side of said rung 14 and which engages the inner side of the next lower rung 15, to retain the platform 35 in its substantially horizontal position, as seen in FIGS. 4 and 5.

FIGS. 6 to 9 illustrate another embodiment of the invention comprising a selfsustaining ladder 38, which also consists of five curved rungs 39, 40, 41, 42 and 43, and five uprights 44, 45, 46, 47 and 48. The rungs are secured to each of the uprights either by nut and bolt fastenings 49 or U-bolt and nut fastenings 50. All of the uprights extend to below the lower rung 43. A straight brace 51 extends between and is secured to the end uprights 44 and 48, adjacent their lower ends and substantially below the level of the bottom rung 43. The end uprights 44 and 48, at their lower ends, terminate in laterally turned, horizontally disposed terminals 52 which are disposed parallel to one another and provide journals for a pair of wheels 53. Braces 54 extend between the uprights 44 and 48 and the bottom rung 43.

Figure 7:
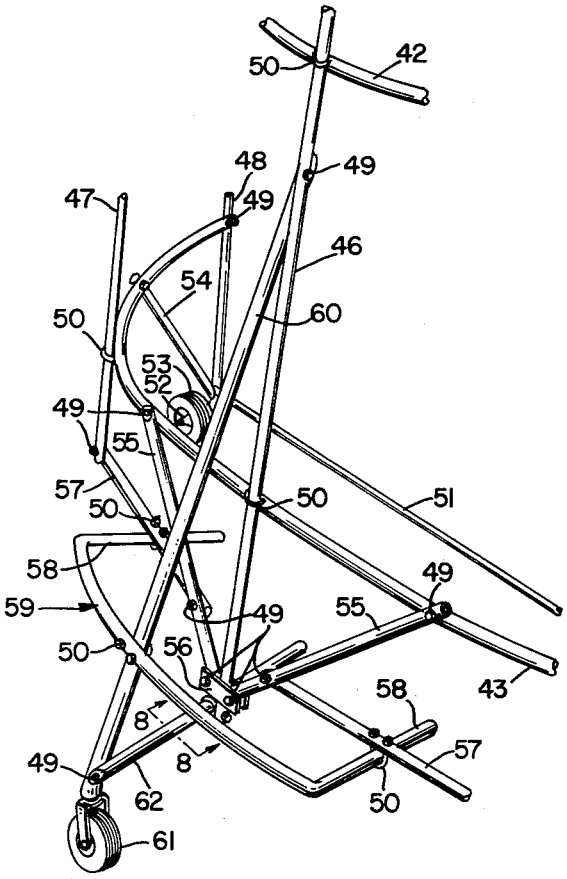
FIG. 7 is an enlarged fragmentary perspective view of a portion of the ladder of FIG. 6 and looking toward the outer, convex side thereof.
Figure 8:
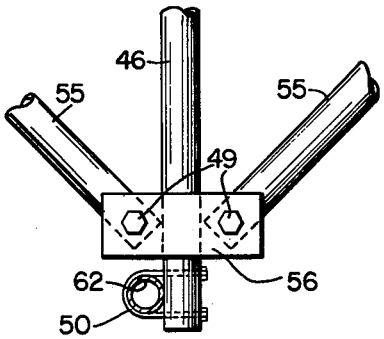
FIG. 8 is an enlarged fragmentary sectional view taken substantially along a plane as indicated by the line 8—8 of FIG. 7.

As best seen in FIG. 7, corresponding braces 55 have upper ends secured by fastenings 49 to the rung 43. Braces 55 extend downwardly in converging relation to one another and are secured at their lower ends by additional fastenings 49 in between the ends of a pair of plates 56, as best seen in FIG. 8. A lower part of the intermediate upright 46 extends through the plates 56, between the braces 55. Uprights 45 and 47 extend to below the bottom rung 43 but terminate above the level of the channel member 56, which, in turn, is disposed above the level of the axles 52. Brace members 57 extend between the lower ends of the uprights 45 and 47 and the braces 55, located adjacent to said uprights, and said braces 57 are secured by fastenings 49 to said uprights and to the braces 55, as best seen in FIG. 7.

The legs 58 of a U-shaped member 59 engage through U-fastenings 50 which are connected to the braces 57. An elongated rigid rod 60, forming a leg, has an upper end pivotally connected by a fastening 49 to the upright 46, between the rungs 42 and 43. Leg 60 extends downwardly through a U-fastening 50 which is connected to an intermediate portion of the member 59. A caster wheel 61 is connected to the lower end of the leg 60. A rod 62 has an outer end pivotally connected by a fastening 49 to the leg 60, below the member 59, and said rod extends through a U-fastening 50 which is supported by the upright 46.

The ladder 38 is shaped like the ladder 10 and for the reasonsheretofore set forth. The intermediate upright 46 extends above the upper rung 39 for the same reason that the upright 18 extends above the rung 11, as previously described. Ladder 38 is selfsustaining and may be readily moved on the wheels 53 and 61 to position the ladder 38 in close proximity to different segments of a fruit tree to be harvested, or a tree to be trimmed or otherwise worked upon. reasons heretofore The inclination of the ladder 38 may be varied as illustrated in diagramatically in FIG. 9, by loosening the fastenings 50 of the braces 57 so that the legs 58 can slide through said fastenings 50 for moving the U-member 59 outwardly or inwardly of the ladder 38. The fastening 50 of the upright 46 is left loose so that the rod 62 can slide freely therethrough. Accordingly, the leg 60 will pivot about its connection to the upright 46 as the U-shaped member 59 and rod 62 slide outwardly from their full line to their broken line positions of FIG. 9, for moving the ladder 38 from an incline toward a more upright position to better conform to the vertical curvature of a tree, not shown. Further, fastenings 50, connecting upright 46 to the rungs are loosened to permit upright 46 to slide vertically therein to further vary the inclination of the ladder 38. The fastenings 50 of the braces 57 can be tightened for securing the member 59 in different adjusted positions relative to the braces 57. Conversely, inward movement of the member 59 relative to the braces 57 will cause the ladder 38 to assume a more tilted position, as from its broken line to its full line position of FIG. 9.

The ladder 10, in combination with the ladder 33, as previously described, and the ladder 38, will permit a trimmer, using the ladders, to observe a tree in its natural shape without any part of the tree being distorted from its natural condition by contact with a part of a ladder.

If desired, one of the wheels 53 could be omitted and the outside upright, not equipped with a wheel, could be lifted slightly and pushed or pulled for moving the ladder 38. Various other modifications and changes are contemplated and may be resorted to, without departing from the function or scope of the invention.

We claim as our invention:

1. A harvesting ladder having an arcuate horizontal curvature to generally conform to the horizontal curvature of a segment of a tree, said ladder including end uprights, a plurality of integral curved rungs each connected at their ends to each of said uprights, and an intermediate upright connected to said rungs.

2. A ladder as in claim 1, adjustable ground engaging support means connected to said ladder intermediate of its ends and cooperating with said end uprights to provide a selfsustaining ladder.

3. A ladder as in claim 2, said adjustable ground engaging support means being movable toward and away from an outer convex side of the ladder to vary the inclination of the ladder.

4. A ladder as in claim 3, said adjustable ground engaging support means including a ground engaging wheel.

5. A ladder as in claim 1, at least one ground engaging wheel connected to one end of the ladder to facilitate movement of the ladder.

6. A ladder as in claim 1, rigid means adapted to be secured to an end of a wheeled vehicle and to which a substantially horizontal part of the ladder is connected for oscillating movement, and a bracket secured to another part of the ladder and adapted to be pivotally connected to an extensible and retractable part of a hydraulic power lift of the vehicle, whereby said ladder can be rocked about said rigid means for moving the ladder between a lower, ground engaging operative position and a raised, inoperative transport position.

7. A ladder as in claim 6, said end uprights having extensible lower sections for varying the inclination of the ladder when in an operative position to generally conform to the vertical curvature of a segment of a tree being harvested.

8. A ladder as in claim 1, and a platform member detachably connected to certain of the ladder rungs and extending inwardly from an inner concave side of the ladder to provide a rest for the foot of a worker supported on the ladder.

* * * * *